United States Patent [19]

Kato et al.

[11] Patent Number: 4,826,750

[45] Date of Patent: May 2, 1989

[54] DEVELOPMENT PROCESS IN ELECTROPHOTOGRAPHY UTILIZING CARBON BLACK OF SPECIFIED COLORING POWER

[75] Inventors: Mamoru Kato, Tokyo; Kouji Maekawa, Kyoto; Kenichi Matsunobu, Neyagawa; Naoka Fujie, Sakai; Hiroyuki Hazama, Neyagawa, all of Japan

[73] Assignee: Mita Industrial Co., Ltd., Osaka, Japan

[21] Appl. No.: 102,679

[22] Filed: Sep. 30, 1987

[30] Foreign Application Priority Data

Sep. 30, 1986 [JP] Japan ..... 61-229981

[51] Int. Cl.[4] ..... G03G 13/09

[52] U.S. Cl. ..... 430/122; 430/106.6

[58] Field of Search ..... 430/46, 106, 106.6, 430/107, 108, 109

[56] References Cited

U.S. PATENT DOCUMENTS 4,126,566 11/1978 Brown ..... 430/108

4,513,074 4/1985 Nash et al. ..... 430/109

*Primary Examiner*—John L. Goodrow

*Attorney, Agent, or Firm*—Sherman & Shalloway

[57] ABSTRACT

A two-component type developer comprising an electroscopic fixable toner containing, as the coloring pigment, carbon black having a coloring power of 100 to 120 and a magnetic carrier is sued for developing electrostatic latent images formed on a photosensitive plate in correspondence to an imitation original and an original, and the image density of the toner image corresponding to the imitation original is detected and the toner concentration in the developer is controlled based on the detected image density. According to this development process, the toner concentration in the developer can be maintained within an optimum range based on the optical density of the toner image formed on the photosensitive plate in correspondence to the imitation original.

8 Claims, 1 Drawing Sheet

DEVELOPMENT PROCESS IN ELECTROPHOTOGRAPHY UTILIZING CARBON BLACK OF SPECIFIED COLORING POWER

BACKGROUND OF THE INVENTION (1) Field of the Invention

The present invention relates to a development process in electrophotography. More particularly, the present invention relates to an improvement in the process for controlling the toner concentration in a developer appropriately based on the optical density of a toner image formed on a photosensitive plate in correspondence to an imitation original.

(2) Description of the Prior Art

In the development process using a two-component type developer comprising a mixture of an electroscopic fixable toner and a magnetic carrier, it is necessary to control the toner concentration (the proportion of the toner) in the developer by some means or other.

This toner concentration should be detected for supplying a toner to the developer, and as means for detecting the toner concentration, there have been practically adopted the process in which the toner level in a development tank is detected, and the process in which the permeability of the developer is detected. However, these processes are defective in that the image density (optical density) of the toner image formed by the development is not well in agreement with the toner concentration in the developer.

Therefore, at the present, there is adopted a process in which the image density of a toner image formed on a photosensitive plate in correspondence to an imitation original is detected and the toner concentration in the developer is controlled based on the detected image density, that is, if the image density is lowered, the toner is supplied into the developer and if the image density is increased, supply of the toner is stopped.

According to this conventional process, the object of maintaining the image density of the toner image on a photosensitive plate at a certain level can be attained, but it was found that the object of maintaining the toner concentration in the developer within an optimum range is not satisfactorily attained.

In fact, the image density of the toner image on the photosensitive plate is seriously influenced by the toner concentration in the developer. However, it was found that in the case where the image density of the toner image is detected and the toner concentration in the developer is controlled based on the detected image density, scattering of toner or tailing in the formed image often takes place.

SUMMARY OF THE INVENTION

It is therefore a primary object of the present invention to provide a development process in which the toner concentration in a developer can be controlled within an optimum range while always maintaining the image density of a toner image formed on a photosensitive plate at a certain level and preventing scattering of a toner or tailing in a formed image.

We found that the kind of carbon black contained in the toner has serious influences on the detected image density of the toner image, and if carbon black having specific properties is selected and used, the above-mentioned defect is overcome and an image can be formed while maintaining the image density at a certain level and preventing scattering of the toner or tailing.

More specifically, in accordance with the present invention, there is provided a development process in the electrophotography, which comprises developing electrostatic latent images formed on a photosensitive plate in correspondence to an imitation original and an original with a two-component type developer comprising a toner and a magnetic carrier, detecting the image density of a toner image corresponding to the imitation original and controlling the toner concentration in the developer based on the detected image density, wherein an electroscopic fixable toner containing, as the coloring pigment, carbon black having a coloring power (DIN 53234) of 100 to 120 is used as the toner.

DETAILED DESCRIPTION OF THE PREFERRED EMBODIMENTS

Figure 1:
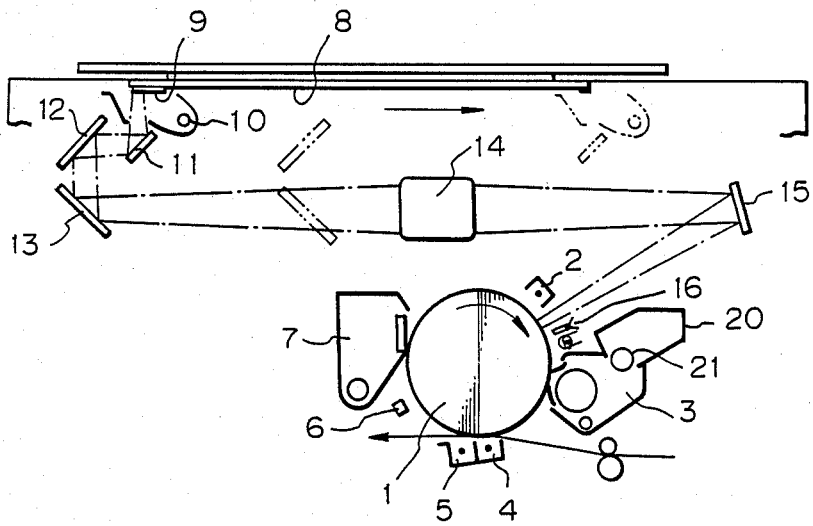
FIG. 1 is a sectional view illustrating an electrophotographic copying machine to which the development process of the present invention is applied.

Referring to FIG. 1 illustrating an electrophotographic copying machine to which the development process of the present invention is applied, a charging charger 2, a developing device 3, a blank lamp 16, a transfer charger 4, a separating charger 5, a reflection type sensor 6 for detecting the toner concentration and a cleaner 7 are arranged in this order around a photosensitive drum 1.

Referential numeral 8 represents a contact glass for supporting an original, and an imitation original 9 is attached to the contact glass 8 at a predetermined position located on the home position side apart from the exposure zone. An optical system comprising a light source 10, reflecting mirrors 11, 12 and 13, a lens 14 and a reflecting mirror 15 is arranged between the contact glass 8 and the photosensitive drum 1.

Accordingly, by movcing the olight source 10 and reflecting mirror 11 at a predetermined speed and moving the reflecting mirrors 12 and 13 at 1/2 of this predetermined speed, the original supported on the contact glass 8 is exposed to light which is guided to the surface of the photosensitive drum 1.

The photosensitive drum 1 is rotated in one direction, and with rotation of the photosensitive drum 1, charging by the charging charger 2, formation of an electrostatic latent image by irradiation with reflected light from the original through the above-mentioned optical system, development of the latent image with a two-component type developer by the developing device 3, transfer of the toner image to a copy sheet by the transfer charger 4, peeling of the copy sheet by the separating charger 5, detection of the density of the toner image by the reflection type sensor 6 and recovery of the residual toner by the cleaner 7 are carried out. At each operation, an electrostatic latent image corresponding to the imitation original 9 is formed on the photosensitive drum 1, and by controlling lighting of the blank lamp 16, the latent image can be visualized to a toner image only once at a predetermined number of the operations.

Figure 2:
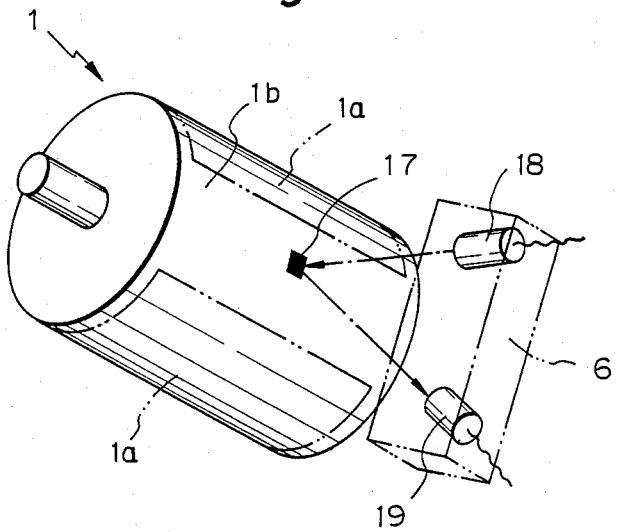
FIG. 2 is a perspective view illustrating the state of detection of the toner concentration.

As shown in FIG. 2, the photosensitive drum 1 has a copied image-forming portion 1a and a blank portion 1b not used for the reproduction of the original, and a toner image 17 corresponding to the above-mentioned imitation original 9 is formed on this blank portion 1b. The reflection type sensor 6 comprises an infrared ray-emitting luminescent element (luminescent diode) 18 and a light-receiving element (phototransistor) 19 for receiving reflected light through the toner image 17, and by the combination of these elements, the toner density of the toner image 17 corresponding to the imitation original 9 is detected as an electric signal.

The developing device 3 comprises a toner supply tank 20 and a toner supply roller 21, and by performing on-off control of the toner supply roller 21 based on the above-mentioned detection signal, the toner concentration in the developer is controlled so that the image density of the toner image is maintained within a certain range.

According to the present invention, in the above-mentioned development process, the toner concentration can be maintained at an optimum value by using an electroscopic toner containing, as the coloring pigment, carbon black having a coloring power (DIN 53234) of 100 to 120. The coloring power referred to in the instant specification and appended claims is a characteristic value determined by mixing a certain amount of carbon black into a certain amount of stipulated zinc flower and measuring reflected light, and a larger value of the coloring power is obtained when the blackness is low. The reason why the coloring power of carbon black is restricted to 100 to 120 in the present invention is as follows.

When a toner comprising carbon black having a coloring power smaller than 100 is used, the image density of the toner image on the drum is detected as a smaller value, with the result that the toner is excessively supplied into the developer, the toner concentration in the developer becomes too high from the viewpoint of the electroscopic characteristics and scattering of the toner is increased. If a toner comprising carbon black having a coloring power larger than 120 is used, the image density of the toner image on the drum is detected as a larger value, with the result that the toner is not sufficiently supplied into the developer, the toner concentration in the developer becomes too low from the viewpoint of the electric characteristics of the entire developer and troubles such as tailing are caused. In contrast, according to the present invention, by selecting and using carbon black having a coloring power of 100 to 120 as the carbon black to be incorporated into the toner, a strict correspondence relation between the detected image density and the actual image density of the toner image can be established and the toner concentration in the developer can be strictly set relatively to the image density of the toner image. Accordingly, the image density of the toner image can always be maintained at a certain level while preventing scattering of the tone or tailing in the image.

The toner used in the present invention can be obtained according to the known recipe by the known preparation process except that carbon black having a coloring power of 100 to 120 is used. Carbon blacks of this type are available under the tradenames of High Color Channel (HCC), Medium Color Channel (MCC), Regular Color Channel (RCC), Medium Color Furnace (MCF) and Regular Color Furnace (RCF). High Color Furnace (HCF) has a coloring power exceeding the range specified in the present invention and Low Color Furnace (LCF) has a coloring power smaller than the range specified in the present invention, and these carbon blacks are not suitable for attaining the object of the present invention.

The above-mentioned carbon black, together with other toner additives if necessary, is dispersed in a resin medium having a heat fixing property, and the mixture is granulated to form toner particles. As the resin, there can be used thermoplastic resins, and uncured thermosetting resins and precondensates of thermosetting resins. As preferred examples, there can be mentioned a vinyl aromatic resin, an acrylic resin, a polyvinyl acetal resin, a polyester resin, an epoxy resin, a phenolic resin, a petroleum resin and an olefin resin in an order of the importance.

It is preferred that the amount incorporated of carbon black in the toner be 4 to 15% by weight, especially 6 to 10% by weight, based on the toner. As components to be incorporated into the toner, there can be mentioned a charge controlling agent and an offset preventing agent. For example, as the charge controlling agent, there can be used oil-soluble dyes such as Nigrosine Base (CI 5045), Oil Black (CI 26150) and Spiron Black, and metal salts of naphthenic acid, metal soaps of fatty acids, resin soaps and metal-containing azo dyes. Furthermore, parting agents such as a low-molecular-weight polypropylene resin and a silicone oil are added to prevent occurrence of the offset phenomenon at the hot roll fixing step. Moreover, silane-treated gas-phase method silica or the like can be applied to the surfaces of the toner particles to improve the flowability of the toner particles.

It is preferred that the particle size of the toner particles be 5 to 25 μm, especially 8 to 20 μm. In view of the transfer characteristics and the electric characteristics at the development step, it is preferred that the electric resistance of the toner particles be $1\times10^{13}$ to $5\times10^{15}$ Ω-cm.

As the magnetic carrier, there can be mentioned an iron powder carrier of a spherical or indeterminate (irregular) shape and a ferrite carrier of a spherical shape. A magnetic carrier having a coating layer of an acrylic resin or fluorine resin can be used.

The mixing ratio between the magnetic toner and the toner is adjusted so that the image density of the toner image corresponding to the imitation original is within a certain range, as pointed out hereinbefore. Various standards can be adopted for setting this image density. For example, the electric resistance between the sleeve of the developing magnetic brush and the photosensitive drum is used as the standard. More specifically, if this electric resistance of the magnetic brush of the developer (a voltage of 200 V is applied) is lower than $2.0\times10^{8}$ Ω, tailing is caused, and if this electric resistance is higher than $4.0\times10^{8}$ Ω, scattering of the toner is easily caused. Accordingly, the toner concentration in the developer can be set based on the image density of a toner image formed by a developer having an electric resistance within the above-mentioned range of $2.0\times10^{8}$ to $4.0\times10^{8}$ Ω.

As another method, there can be mentioned the following method proposed by us. Namely, since the optimum toner concentration (Ct) in the developer can be represented by the following formula:

$$Ct=k\cdot(Sc/St+Sc)\times100 \quad (1)$$

wherein Sc stands for the specific surface area ($cm^2/g$) of the magnetic carrier, St stands for the specific surface area ($cm^2/g$) of the toner, and k is a number of from 0.8 to 1.2, the toner concentration can be set based on the image density obtained at this toner concentration.

The effects of the present invention will now be illustrated with reference to the following examples.

EXAMPLE 1

Recipe of Toner-Constituting Materials

Styrene-acrylic resin: 100 parts by weight
Printex L (coloring power: 7 parts by weight (DIN 53234) of 102)
Wax: 1.5 parts by weight
Charge controlling agent: 2 parts by weight The above-mentioned materials were pre-mixed for 15 minutes by a Henschel mixer and heat-kneaded by a biaxial extruder to obtain a toner. A developer having a toner concentration of 5% by weight was prepared from this toner and an acrylic resin-coated carrier.

The image test was carried out by using the soobtained developer in an electrophotographic copying machine (Mita DC-513Z). Either at the initial stage or after 50,000 prints had been obtained, tailing was not observed in the formed image. In any of 50,000 prints, influences of scattering of the toner on the formed prints were not observed. After 50,000 prints had been obtained, the toner concentration in the developer was 3.2% by weight.

EXAMPLE 2

A toner was prepared in the same manner as described in Example 1 except that Printex 45 having a coloring power (DIN 53234) of 117 was used instead of Printex L, and a developer having the same toner concentration (5% by weight) as in Example 1 was prepared.

The image test was carried out in DC-513Z in the same manner as described in Example 1. Either at the initial stage or after 50,000 prints had been obtained, an image free of tailing was obtained as in Example 1. Moreover, influences of scattering of the toner were not obtained in 50,000 prints as in Example 1. After 50,000 prints had been obtained, the toner concentration in the developer was 2.5% by weight.

COMPARATIVE EXAMPLE 1

A toner was prepared in the same manner as described in Example 1 except that Printex 25 having a coloring power (DIN 53234) of 88 was used instead of Printex L, and a developer having the same toner concentration (5% by weight) as in Example 1 was prepared.

The image test was carried out in DC-513Z in the same manner as described in Example 1. Either at the initial stage or after 50,000 prints had been obtained, an image free of tailing was obtained. However, contamination of the image by scattering of the toner was observed after 50,000 prints had been obtained. After 50,000 prints had been obtained, the toner concentration in the developer was 4.6% by weight.

COMPARATIVE EXAMPLE 2

A toner was prepared in the same manner as described in Example 1 except that Printex 80 having a coloring power (DIN 53234) of 125 was prepared instead of Printex L, and a developer having the same toner concentration (5% by weight) as in Example 1 was prepared. The image test was carried out in DC-513Z in the same manner as described in Example 1. An image free of tailing was obtained at the initial stage, but after 50,000 prints had been obtained, tailing was caused in the formed image. After 50,000 prints had been obtained, the toner concentration in the developer was 2.0% by weight.

We claim:

1. In a development process in electrophotography which comprises: developing electrostatic latent images on a photosensitive plate in correspondence to an imitation original and an original with a two-component type developer comprising an electroscopic fixable toner and a magnetic carrier; detecting the image density of a toner powder image on the photosensitive plate corresponding to said imitation original; and controlling the toner concentration in the two-component type developer at an optimum level based on the detected image density; the improvement wherein said toner comprises a resin medium having a heat fixing property and 4 to 15% by weight, based on the toner, of carbon black having a coloring power, measured by DIN 53234, of 100 to 120, said toner has an electric resistance of $1\times10^{13}$ to $5\times10^{15}$ Ω-cm, and said image density of said toner powder image on said photosensitive plate corresponding to said limitation original is detected by emission and receipt of infrared rays.

2. The process according to claim 1, wherein said resin medium comprises thermoplastic resins, thermosetting resins or pre-condensates of thermosetting resins.

3. The process according to claim 2, wherein said resin medium is selected from the group consisting of vinyl aromatic resin, acrylic resin, polyvinyl acetal resin, polyester resin, eposy resin, phenolic resin, petroleum resin and olefin resin.

4. The process according to claim 1, wherein said toner comprises 6 to 10% by weight, based on the toner, of said carbon black.

5. The process according to claim 1, wherein said toner further comprises a charge controlling agent selected from the group consisting of oil-soluble dyes, metal salts of naphthenic acid, metal soaps of fatty acids, resin soaps and metal-containing azo dyes.

6. The process according to claim 1, wherein said toner further comprises a parting agent selected from the group consisting of low-molecular-weight polypropylene resin and silicone oil.

7. The process according to claim 1, wherein said toner has a particle size of 5 to 25 μm.

8. The process according to claim 7, wherein said toner has a particle size of 8 to 20 μm.

* * * * *

UNITED STATES PATENT AND TRADEMARK OFFICE

CERTIFICATE OF CORRECTION

PATENT NO. : 4,826,750

DATED : May 2, 1989

INVENTOR(S) : MAMORU KATO, ET AL.

It is certified that error appears in the above-identified patent and that said Letters Patent is hereby corrected as shown below:

IN THE CLAIMS

Column 6, claim 1, line 33, delete "limitation", insert --imitation--.

Column 6, claim 3, line 42, delete "eposy", insert --epoxy--.

Signed and Sealed this

Tenth Day of October, 1989

*Attest:*

*Attesting Officer*

DONALD J. QUIGG

*Commissioner of Patents and Trademarks*